US005128695A

United States Patent [19]

Maeda

[11] Patent Number: 5,128,695

[45] Date of Patent: Jul. 7, 1992

[54] IMAGING MATERIAL PROVIDING DEVICE

[75] Inventor: Masataka Maeda, Kounan, Japan

[73] Assignee: Brother Kogyo Kabushiki Kaisha, Nagoya, Japan

[21] Appl. No.: 681,002

[22] Filed: Apr. 5, 1991

[30] Foreign Application Priority Data

Jul. 27, 1990 [JP] Japan ..... 2-200215

[51] Int. Cl.[5] ..... B41J 2/005; B41J 2/415

[52] U.S. Cl. ..... 346/140 R; 346/159

[58] Field of Search ..... 346/140 R, 159; 355/215, 225, 246, 247, 249, 250, 251, 259, 261-264; 118/653-657; 101/DIG. 37

[56] References Cited

U.S. PATENT DOCUMENTS

| | | | |
|---|---|---|---|
| 3,689,935 | 9/1972 | Pressman et al. | 346/159 |
| 4,491,855 | 1/1985 | Fujii et al. | 346/159 |
| 4,498,090 | 2/1985 | Honda et al. | 346/159 |
| 4,743,937 | 5/1988 | Martin | 355/259 |
| 4,947,211 | 8/1990 | Ono et al. | 355/265 |
| 5,017,967 | 5/1991 | Koga | 355/261 |

FOREIGN PATENT DOCUMENTS 0178679 7/1990 Japan .

OTHER PUBLICATIONS

Hamilton, W. R., "Roll Fuser with Vacuum Tack", IBM TDB, vol. 14, No. 4, Sep. 1971, p. 1158.

*Primary Examiner*—Benjamin R. Fuller
*Assistant Examiner*—Alrick Bobb
*Attorney, Agent, or Firm*—Oliff & Berridge

[57] ABSTRACT

In an image recording apparatus of this invention, a high voltage is applied to a blade for scratching a brush roller on which the toner particles are supported. The high voltage applicator is installed in an image recording apparatus which supplies toner particles in the vicinity of a particle control electrode so as to form a mist of toner particles by scratching a brush roller on which the toner particles are supported. The particle control electrode includes apertures allowing passage of toner particles to control image information. An image is formed on a recording medium provided at an opposite side of a toner particle supplying source. The tip of the blade to which a high voltage is applied generates a corona discharge, so that the toner particles can obtain a required amount of charge and the electric field enabling the toner particles to pass through the apertures can be controlled easily.

18 Claims, 2 Drawing Sheets

IMAGING MATERIAL PROVIDING DEVICE

BACKGROUND OF THE INVENTION

1. Field of the Invention

The present invention relates to an image recording apparatus which directly controls a flow of charged toner particles and records an image on a recording medium, and more particularly to an image recording apparatus capable of increasing a charged amount of toner particles.

2. Description of Related Art

There has been conventionally proposed an image recording apparatus which generates an electric field between a control electrode having apertures which can pass charged coloring particles (hereinafter referred to as toner particles) and a back electrode, the image recording apparatus recording the image on a recording medium inserted between both electrodes, by directly controlling the charged toner particles. As an example of this kind of image recording apparatus, there has been proposed an image recording apparatus disclosed in U.S. Pat. No. 3,689,935.

It was difficult, however, to control the toner particles directly by the electric field generated between both electrodes in the above image recording apparatus, unless the large quantity of charged toner particles is transported in the vicinity of the control electrode, and unless the toner particles are supplied so as to form a mist of toner particles.

In order to solve this problem, the inventor of the present invention proposed the image recording apparatus specified in Japanese patent application No. 2-10906 which is capable of transporting the large quantity of charged toner particles in the vicinity of a control electrode and supplying the toner particles so as to form a mist of toner particles. The large quantity of charged toner particles was transported in the vicinity of the control electrode by rotation of a brush roller having a brush supporting the large quantity of charged toner particles thereon. A scratch blade was installed in the position where it contacts the brush of the brush roller, so that the brush would contact the scratch blade and be bent by its own elasticity when the brush roller rotated. When the brush roller further rotated, the brush bent further and came off from the scratch blade. Then, the brush returned to an original condition by its own elasticity. At this moment, the toner particles which were supported on the brush separated from the brush. As a result, the toner particles which separated from the brush formed a mist of toner particles and were supplied below the control electrode.

However, in the image recording apparatus thus constructed, the charged amount of the toner particles is very small because the toner particles are only charged triboelectrically. When the charged amount of the toner particles is small, it is difficult to control the modulation of the flow of the toner particles by the electric field generated between the control electrode and the back electrode. Therefore, the conventional image recording apparatus had many problems such as slow image recording speed, and the apparatus became very large and expensive because it needs to drive the control electrode by applying a high voltage and it is difficult to make the control circuit to IC.

SUMMARY OF THE INVENTION

An object of the present invention is, therefore, to provide an image recording apparatus which has a simple and cheap structure but enables speedy recording of an image. More specifically, the object of the present invention is to provide an image recording apparatus capable of controlling the flow of the toner particles even if the back electrode is driven at low voltage by providing a required and sufficient amount of charge to the toner particles supplied in the vicinity of the control electrode.

In order to achieve the above object, an image recording apparatus of the present invention comprises: carrying means having a ciliary member which supports charged particles on its surface; a control electrode having apertures through which the particles supported by the carrying means can pass; a back electrode confronting the carrying means through the control electrode, the back electrode being spaced from the control electrode by a space allowing passage of a support member on which an image is recorded; a scratch member for supplying particles supported by the ciliary member below the control electrode by scratching the ciliary member to form a mist of particles, the scratch member being arranged in a position where it contacts the ciliary member which supports the particles thereon; and charging means for adhering an ionized ion to the particles supplied as a mist.

According to the image recording apparatus of the present invention thus constructed, the charging means adheres the ionized ion onto the particles, so that it becomes possible to provide a sufficient amount of charge to the particles and to easily control the electric field of the particles.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
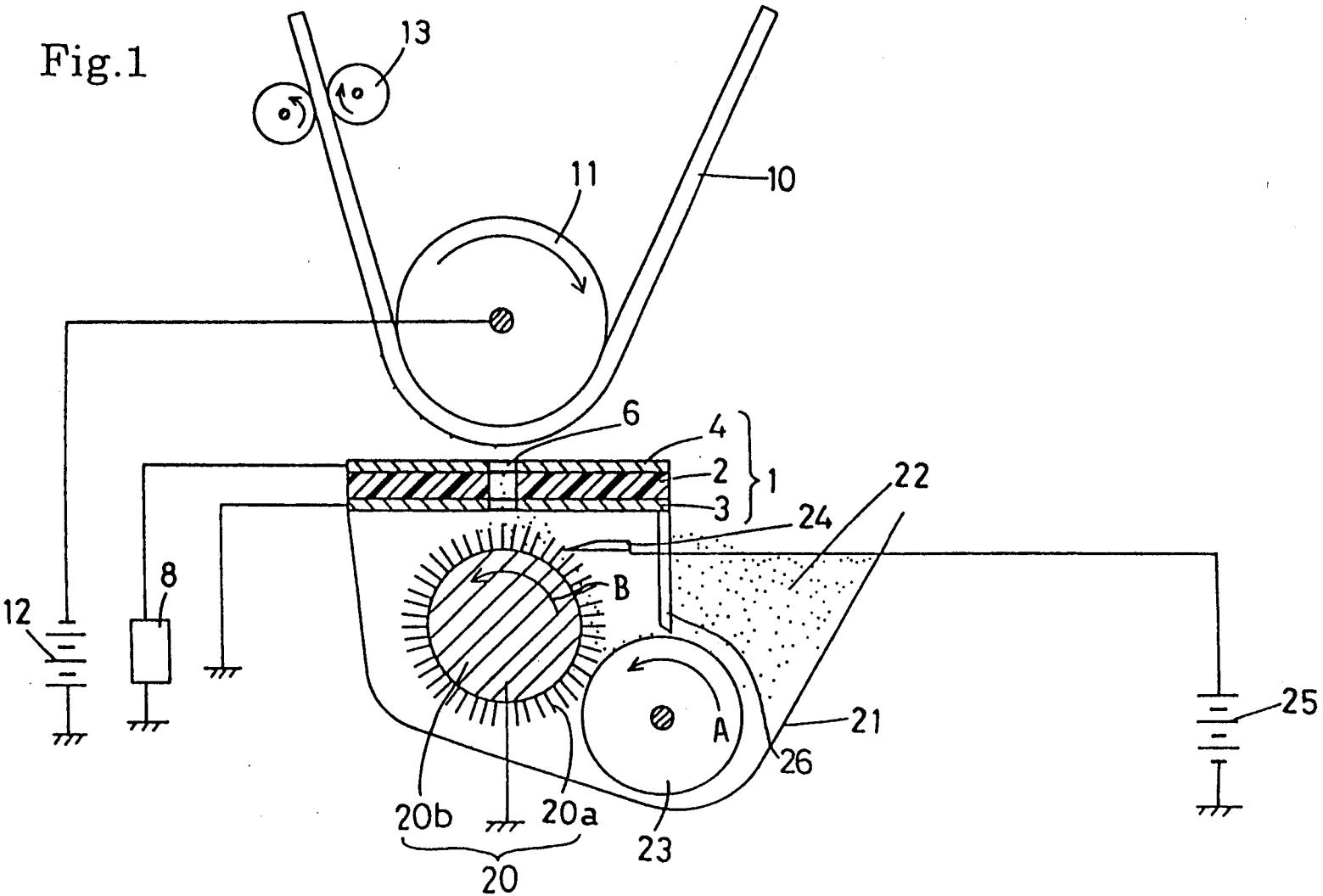
FIG. 1 shows a construction of an image recording apparatus which embodies this invention.

Referring now to the accompanying drawings, a preferred embodiment of the invention will be described in detail.

First, the construction of an image recording apparatus of this embodiment will be described with reference to FIG. 1.

The image recording apparatus is roughly divided into a toner supplying portion, a toner controlling portion, and a toner fixing portion.

The toner supplying portion comprises a toner case 21, a brush roller 20, a supply roller 23, a scratch blade 24, and a layer thickness regulating blade 26.

The brush roller 20, the supply roller 23 and the scratch blades 24 are provided in the toner case 21 in which toner particles 22 are stored. Further, the toner case 21 is grounded.

The supply roller 23 is a roller to be rotated in the direction indicated by the arrow A shown in FIG. 1 by a driving source (not shown) and is provided in the toner case 21. A center shaft of the supply roller 23 is preferably metal but the periphery is formed of sponge or plastic, etc. The supply roller 23 is for supplying the toner particles 22 to the brush roller 20.

The brush roller 20 is a roller to be rotated in the direction indicated by the arrow B shown in FIG. 1 by a driving source (not shown) and is also provided in the toner case 21 as is the supply roller 23, and is arranged under a particle control member 1 to be described later. The brush roller 20 comprises a ciliary member or brush 20*a* which comprises cloth and a brush roller shaft 20*b* of a metal such as aluminum. Further, the brush roller shaft 20*b* is grounded. The brush roller 20 is provided with its brush roller shaft 20*b* extending parallel to the center shaft of the supply roller 23, and both rollers come in contact with each other. The toner particles 22 transported by the supply roller 23 come in contact with the brush 20*a* of the brush roller 20 and are moved towards the brush 20*a*. Therefore, the brush roller 20 transports the toner particles 22 under the particle control member 1.

The scratch blade 24 is also provided in the toner case 21. The scratch blade 24 is a blade made of sharpened metal. The scratch blade 24 is arranged to come in contact with the brush 20*a* of the brush roller 20 and scratches the brush 20*a* during rotation of the brush roller 20. The toner particles 22 are supported on the brush 20*a*. When the brush 20*a* is scratched by the scratch blade 24, the toner particles 22 which are being supported by the brush 20*a* are separated to form a mist of toner particles and are supplied below the particle control member 1. Moreover, the scratch blade 24 is connected to a high charging voltage power supply 25, so that an unequal electric field is generated between the sharp scratch blade 24 and the grounded brush roller shaft 20*b*. Then, the positive ion ionized by the strong electric field generated in the space around the scratch blade 24 flows to the brush roller shaft 20*b*. The positive ion adheres to the toner particles 22 in this manner. Therefore, the toner particles 22 are strongly charged in a positive polarity by the positive ion.

The layer thickness regulating blade 26 is also provided in the toner case 21. In this embodiment, the layer thickness regulating blade 26 is arranged under the particle control member 1. The tip end of the layer thickness regulating blade 26 is close to the surface of the supply roller 23. Therefore, the layer thickness regulating blade 26 is provided to make constant the layer thickness of the toner particles 22 which adhere to the surface of the supply roller 23 by the rotation of the supply roller 23 in the direction indicated by the arrow A shown in FIG. 1. The toner particles 22 whose layer thickness is made constant by the layer thickness regulating blade 26 come in contact with the brush 20*a* of the brush roller 20.

The toner controlling portion comprises a particle control member 1 and an electrode roller 11.

Figure 2:
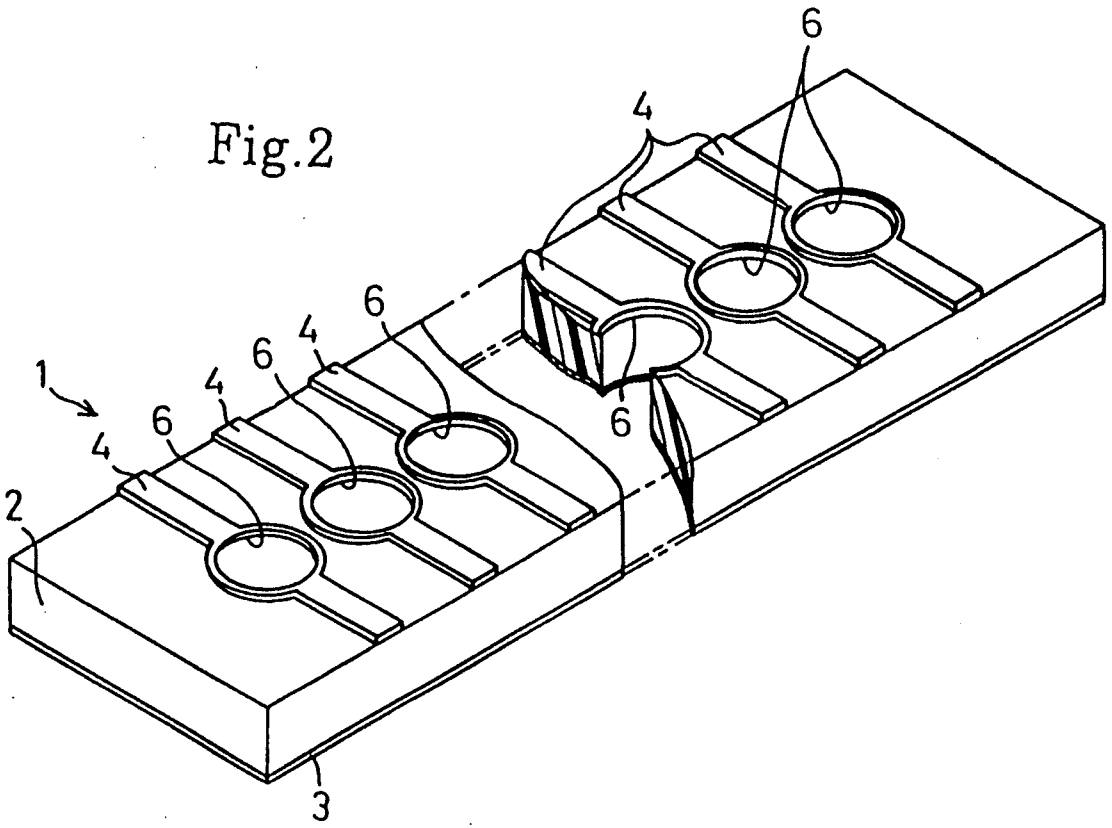
FIG. 2 is a perspective view showing the particle control member.

The particle control member 1 is provided above the brush roller 20 as mentioned above. The construction of the particle control member 1 of this embodiment will be described with reference to FIG. 2. FIG. 2 is a perspective view showing this particle control member 1.

The particle control member 1 comprises a plurality of apertures 6, an insulative layer 2, a reference electrode 3 and a plurality of segment control electrodes 4. The insulative layer 2 is a thin board which consists of an insulating material. Any material can be used as an insulating material if the material has the insulating character. It is thus possible to use films such as resin, ceramic, and PET (polyethylene terephthalate) film. The reference electrode 3 is installed on the side of brush roller 20 of the insulative layer 2 and is a grounded metallic layer. Apertures 6 penetrate through the insulative layer 2 and the reference electrode 3. Moreover, apertures 6 are arranged in one line. In addition, each segment control electrode 4 is a metallic layer installed independently around the aperture 6 and at an opposite side of the insulative layer 2 with respect to the location of the reference electrode 3. Each segment control electrode 4 is connected to a control voltage drive circuit 8 generating the voltage by an image signal, the control voltage drive circuit 8 being installed corresponding to the number of the segment control electrodes 4.

The electrode roller 11 is installed confronting the brush roller 20 through the particle control member 1. The central shaft of the electrode roller 11 is made of conductive metal, and the outer periphery of the electrode roller 11 is made of rubber for easily transporting a recording medium 10 on which an image will be recorded. There is a certain space between the electrode roller 11 and the particle control member 1 through which the recording medium 10 can pass. Moreover, the electrode roller 11 is constructed to rotate when it contacts the recording medium 10 by a driving source (not shown) and is connected to a high voltage power supply 12. The recording medium 10 is transported by the rotation of the electrode roller 11.

In the toner fixing portion, the toner particles 22 which are adhered on the recording medium 10 in the toner controlling portion are thermally fixed on the recording medium 10. The toner fixing portion has a heat source (not shown) and is constructed from a pair of heat rollers 13 whose surface is coated with silicon or PTFE (polytetrafluoroethylene). The toner fixing portion is constructed so that the recording medium 10 on which the toner particles 22 are adhered according to the image signal in the toner controlling portion may pass between the pair of heat rollers 13. The pair of heat rollers 13 also rotates in the direction indicated by the arrow shown in FIG. 1 by a driving source (not shown).

Next, the operation of the image recording apparatus of the present embodiment thus constructed will be described with reference to FIG. 1 and FIG. 2.

When a user presses a start switch (not shown) for recording an image, the image recording apparatus starts to record the image on the image recording medium 10.

First, the supply roller 23 and the brush roller 20 start to rotate in each direction indicated by the arrow A and B in the toner case 21. When the supply roller 23 rotates in the direction indicated by the arrow A, the toner particles 22 are rubbed on the surface of the supply roller 23 and are slightly charged. In this embodiment, the toner particles 22 are slightly charged in a positive polarity. The toner particles 22 slightly charged in a positive polarity are supported on the surface of the supply roller 23. When the toner particles 22 are excessively supported on the surface of the supply roller 23, the layer thickness regulating blade 26 removes the excess toner particles 22 on the surface of the supply roller 23, as the supply roller 23 rotates in the direction indicated by the arrow A. Therefore, the layer thickness of the toner particles 22 supported on the surface of the supply roller 23 will be regulated to become constant. The toner particles 22 which are supported on the surface of the supply roller 23 and whose thickness is regulated to become constant by the layer thickness regulating blade 26 are transported by further rotation of the supply roller 23 in the direction indicated by the arrow A until coming in contact with the brush 20*a* of the brush roller 20. The toner particles 22 which have been transported and which are supported on the surface of the supply roller 23 move from the surface of the supply roller 23 to the brush 20*a* of the brush roller 20, because the brush roller 20 is grounded. At this time, the toners 22 are further charged in a positive polarity as the toner particles 22 are further rubbed by coming in contact with the brush 20*a*.

Next, the toner particles 22 which are supported on the brush 20*a* of the brush roller 20 are transported toward the scratch blade 24 by further rotation of the brush roller 20 in the direction indicated by the arrow B. At this time, because the positive high charging voltage is applied from the high charging voltage power supply 25 to the scratch blade 24, a strong unequal electric field is generated between the sharp scratch blade 24 and the grounded brush roller shaft 20*b*. Then, the positive ion ionized by the strong electric field generated in the space around the scratch blade 24 flows to the brush roller shaft 20*b*, and the toner particles 22 are strongly charged in a positive polarity as the positive ion adheres to the toner particles 22. As mentioned above, the scratch blade 24 separates the toner particles 22 in the form of a mist and supplies the toner particles 22 below the particle control member 1.

The recording medium 10 on which the image is formed is transported between the particle control member 1 and the electrode roller 11 by the rotation of the electrode roller 11. At this time, the toner particles 22 supplied under the particle control member 1 in the form of a mist are directly controlled by the image signal of a low control voltage which is applied to each connected segment control electrode 4 by each control voltage drive circuit 8, and the toner image is formed on the image recording medium. At this time, the voltage which is opposite to the polarity in which the toners 22 are charged, a negative voltage in this embodiment, is always applied to the electrode roller 11. In a nonimage portion, the control voltage which has the same polarity in which the toner particles 22 are charged is applied to the segment control electrode 4. Therefore, the toner particles 22 do not pass through the aperture 6 at a nonimage portion. In an image portion, the control voltage which has the opposite polarity to that which the toner particles 22 are charged is applied to the segment control electrode 4. The toner particles 22 are passed through the apertures 6 by the potential difference and are supplied to the recording medium 10. The toner image thus formed on the recording medium 10 is fixed as the recording medium 10 passes through the fixing device 13.

The toner particles 22 are charged by corona electrical discharge between the scratch blade 24 and the brush roller shaft 20*b*. The triboelectric charge between the toner particles 22 and the brush 20*a*, and between the toner particles 22 and the supply rollers 23 are further added to the original charge. The toner particles 22 have a large amount of charge. The force which the toner particles 22 receive from the electric field is proportionate to the charging amount of the toner particles 22. Therefore, in the limited control voltage, the highly charged toner particles 22 are easier to control since the range of the amount of toner particles 22 which can be induced to pass through the apertures 6 is expanded. Furthermore, the diameter of the flow of the toner particles 22 which is controlled by the limited control voltage is expanded.

According to the image recording apparatus of the present invention, it becomes possible to control the amount and the flow of the toner particles 22 which pass through the apertures 6 by a low control voltage of the image signal, and to provide the image recording apparatus which has a simple and cheap structure but enables speedy recording of the image, since a high charging voltage is applied to the scratch blade 24 for scratching the brush roller 20 on which the toner particles 22 are supported.

While the invention has been described in conjunction with a specific embodiment thereof, it is evident that many alternatives, modifications and variations will be apparent to those skilled in the art. Accordingly, the preferred embodiment of the invention as set forth herein is intended to be illustrative, not limiting. Various changes may be made without departing from the spirit and scope of the invention as defined in the following claims.

What is claimed is:

1. An image recording apparatus comprising:

carrying means having a ciliary member which retains particles thereon;

a control electrode having at least one aperture enabling passage of particles retained by the carrying means;

a back electrode confronting the carrying means opposite an aperture of the control electrode, the back electrode being spaced from the control electrode by a space enabling passage therethrough of a recording medium on which an image is recorded;

a scratch member arranged at a position spaced from the control electrode so as to contact the ciliary member retaining the particles thereon, the scratch member scratching the ciliary member to form a mist of the particles; and charging means connected to said scratch member for providing ionized ions to the mist of the particles regardless of whether said scratch member contacts the mist of particles.

2. The image recording apparatus according to claim 1, wherein the scratch member is conductive.

3. The image recording apparatus according to claim 2, wherein the charging means applies a high voltage to the scratch member.

4. The image recording apparatus according to claim 1, wherein said control electrode comprises:

an insulative layer;

a reference electrode on one surface of said insulative layer; and at least one segment control electrode on an opposite surface of said insulative layer, said at least one aperture passing through said at least one segment control electrode, said insulative layer and said reference electrode.

5. An image recording apparatus comprising:

carrying means having a ciliary member which retains particles thereon;

scratching means for scratching the ciliary member retaining the particles thereon to form a mist of the particles, the scratching means being formed of a conductive material and being connected with a first voltage source to charge the particle regardless of whether said scratching means contacts the particles;

a control electrode having at least one aperture, the control electrode being supplied with an image control voltage to control passage of the mist of the particles through the aperture;

a back electrode communicating with the carrying means through an aperture of the control electrode, the back electrode being spaced from the control electrode by a space enabling passage therethrough of a recording medium on which an image is recorded, the back electrode being connected with a second voltage source having a polarity opposite to that of the first voltage source.

6. The image recording apparatus according to claim 5, wherein the first voltage source is a high voltage source capable of providing ionized ions to the mist of the particles through the scratching means.

7. The image recording apparatus according to claim 5, wherein the first voltage source supplies the scratching means with a charging voltage for charging the mist of the particles, the charging voltage being higher than the image control voltage supplied to the control electrode.

8. The image recording apparatus according to claim 5, wherein the carrying means includes charging means for triboelectrically charging the particles, the ciliary member retaining the charged particles.

9. The image recording apparatus according to claim 8, wherein the charging means trioboelectircally charges the particles to the same polarity as that of a charging voltage from the first voltage source.

10. The image recording apparatus according to claim 5, wherein said control electrode comprises:

an insulative layer;

a reference electrode on one surface of said insulative layer; and at least one segment control electrode on an opposite surface of said insulative layer, said at least one aperture passing through said at least one segment control electrode, said insulative layer and said reference electrode.

11. An image forming apparatus comprising:

a toner supplying portion;

a toner controlling portion; and a toner fixing portion;

wherein said toner supplying portion comprises a brush roller, a supply roller and a scratch blade, said supply roller rotating to supply toner particles to said brush roller, said brush roller comprising a brush supported on a shaft, said brush roller rotating to transport toner particles to said toner controlling portion, said scratch blade contacting said brush as the brush rotates to cause the toner particles to be released from the brush in mist form, said scratch blade being formed of a conductive material and connected to a first voltage source to charge the particles regardless of whether the scratch blade contacts the particles; and an image control voltage drive circuit for generating an image control voltage, a back electrode connected to a second voltage source having a polarity opposite to that of said first voltage source, and a particle control member connected to said image control voltage drive circuit for controlling transportation of the toner particles to a recording medium supported on said back electrode.

12. The image forming apparatus according to claim 11, wherein said particle control member is located between said back electrode and said brush roller.

13. The image forming apparatus according to claim 12, wherein said particle control member comprises:

an insulative layer;

a reference electrode on one surface of said insulative layer;

at least one segment control electrode on an opposite surface of said insulative layer; and at least one aperture passing through said at least one segment control electrode, said insulative layer and said reference electrode.

14. The image forming apparatus according to claim 13, wherein said particle control member includes a plurality of segment control electrodes equally spaced along said opposite surface of said insulative layer.

15. The image forming apparatus according to claim 14, wherein said particle control member includes a plurality of said apertures, and wherein each said aperture is located at a central portion of each said segment control electrode.

16. The image forming apparatus according to claim 13, wherein said back electrode and said brush roller are located adjacent said at least one aperture on opposing sides of said particle control member.

17. The image forming apparatus according to claim 11, wherein said toner supplying portion includes a layer thickness regulating blade for regulating the thickness of toner particles on said supply roller.

18. The image forming apparatus according to claim 11, wherein said first voltage source is a high voltage source for providing ionized ions to the toner particles through said scratch blade.

* * * * *